US008052398B2

(12) United States Patent
Brun et al.

(10) Patent No.: US 8,052,398 B2
(45) Date of Patent: Nov. 8, 2011

(54) RECIPROCATING GAS COMPRESSOR WITH SPEED MODULATION OF COMPRESSOR DRIVER FOR PULSATION AVOIDANCE

(75) Inventors: Klaus Brun, Helotes, TX (US); Dennis Tweten, San Antonio, TX (US); Marybeth Nored, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 576 days.

(21) Appl. No.: 12/274,866

(22) Filed: Nov. 20, 2008

(65) Prior Publication Data

US 2010/0124509 A1 May 20, 2010

(51) Int. Cl.
*F04B 49/00* (2006.01)

(52) U.S. Cl. ..... 417/1

(58) Field of Classification Search ..... 417/18, 417/22, 35, 1, 42, 44.11, 312, 540, 4, 426
See application file for complete search history.

(56) References Cited

OTHER PUBLICATIONS

None.*

* cited by examiner

*Primary Examiner* — Karabi Guharay
*Assistant Examiner* — Elmito Breval
(74) *Attorney, Agent, or Firm* — Attorney Ann C. Livingston

(57) ABSTRACT

A method for reducing pulsation in a gas compressor system. The compressor driver (engine or motor) is operated at a modulated engine speed. The average of the modulated speed is selected to achieve a desired pipeline flow. The modulation characteristics are determined to optimally reduce the pulsation response of the compressor system.

20 Claims, 3 Drawing Sheets

RECIPROCATING GAS COMPRESSOR WITH SPEED MODULATION OF COMPRESSOR DRIVER FOR PULSATION AVOIDANCE

TECHNICAL FIELD OF THE INVENTION

This invention relates to reciprocating compressors for transporting natural gas, and more particularly to a method for reducing pulsations in the compressor system associated with such compressors.

BACKGROUND OF THE INVENTION

To transport natural gas from production sites to consumers, pipeline operators install large compressors at transport stations along the pipelines. Natural gas pipeline networks connect production operations with local distribution companies through thousands of miles of gas transmission lines. Typically, reciprocating gas compressors are used as the prime mover for pipeline transport operations because of the relatively high pressure ratio required. Reciprocating gas compressors may also be used to compress gas for storage applications or in processing plant applications prior to transport.

Reciprocating gas compressors are a type of compressor that compresses gas using a piston in a cylinder connected to a crankshaft. The crankshaft may be driven by an electric motor or a combustion engine. A suction valve in the compressor cylinder receives input gas, which is then compressed by the piston and discharged through a discharge valve.

Reciprocating gas compressors inherently generate transient pulsating flows because of the piston motion and alternating valve motion. Various devices and control methods have been developed to control these pulsations. An ideal pulsation control design reduces system pulsations to acceptable levels without compromising compressor performance.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to using a frequency modulation method to continuously vary the piston speed of a reciprocating compressor. This avoids the creation of coherent wave resonance in the compressor piping system.

Figure 1:
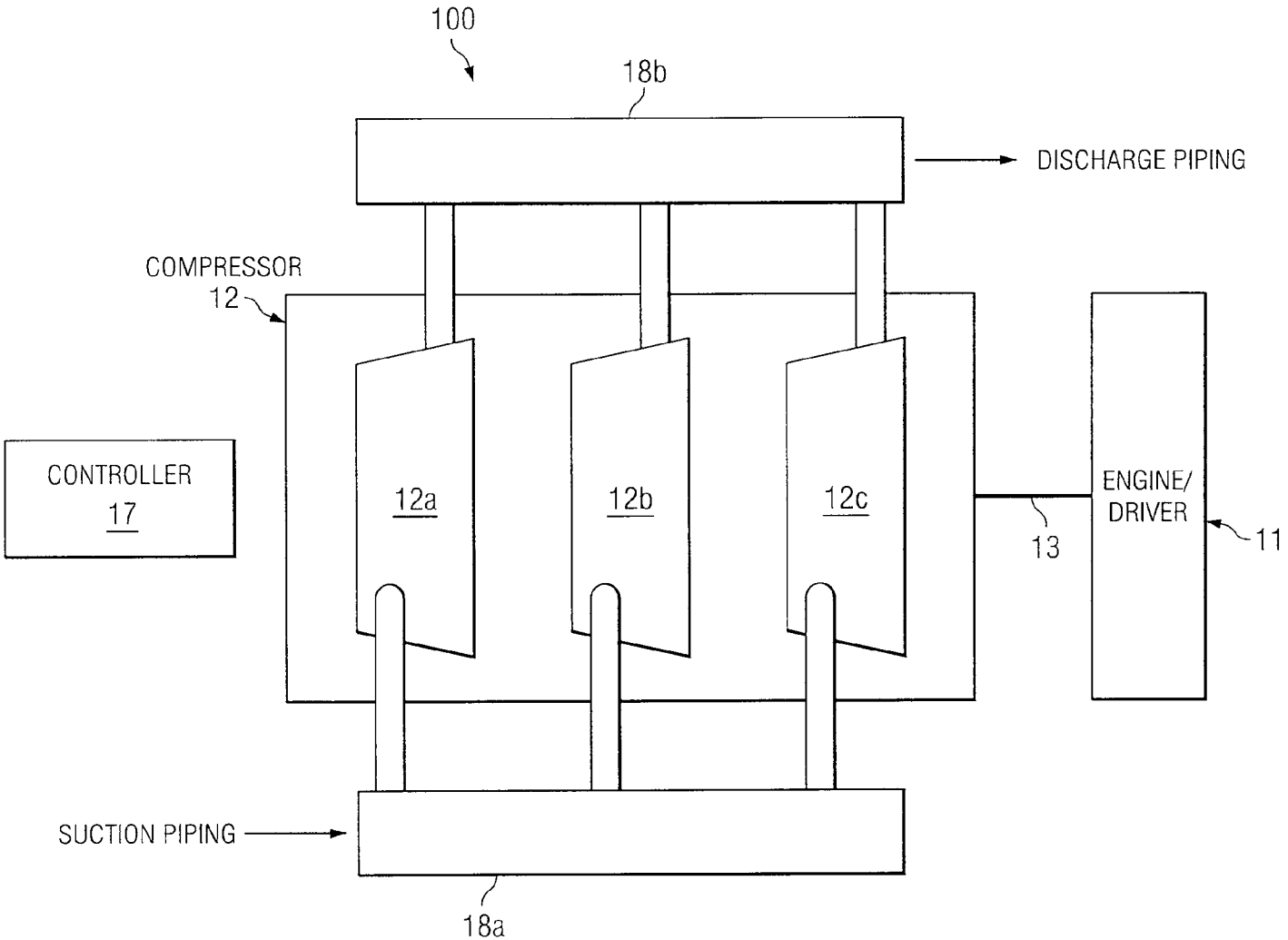
FIG. 1 is a block diagram of a reciprocating gas compressor system.

FIG. 1 is a block diagram of the basic elements of a reciprocating gas compressor system 100 having a control unit 17 in accordance with the invention. Other than control unit 17, the elements of compressor system 100 are depicted as those of a typical or "generic" system, and include a driver 11, compressor 12, suction filter bottle 18*a*, discharge filter bottle 18*b*, suction and discharge piping connections.

In the example of FIG. 1, compressor 12 has three compressor cylinders 12*a*-12*c*. In practice, compressor 12 may have fewer or more (often as many as six) cylinders. Further, it may have either an integral or separate engine or motor driver 11. The output of driver 11 (motor or engine) is unloaded through the compressor. The driver 11 is often an internal combustion engine.

The following description is written in terms of the "generic" compressor system 100. However, the same concepts are applicable to other compressor configurations.

A typical application of compressor system 100 is in the gas transmission industry. The compressor system operates as a "station" between two gas transmission lines. The first line, at an initial pressure, is referred to as the suction line. The second line, at the exit pressure for the station, is referred to as the discharge line. The suction and discharge lines are also referred to in the industry as the "lateral piping". The pressure ratio (discharge pressure divided by suction pressure) may vary between 1.25-4.0, depending on the pipeline operation requirements and the application.

Filter bottles 18*a* and 18*b* may be used to reduce compressor system pulsations. These filter bottles are placed between the compressor and the lateral piping, on the suction or discharge side or on both sides. The effectiveness of filters of this type is dependent on the pulsation frequencies that need to be controlled due to the speed of the compressor.

Controller 17 is used for control of parameters affecting compressor load and capacity. The pipeline operation will vary based on the flow rate demands and pressure variations. The compressor must be capable of changing its flow capacity and load according to the pipeline operation. As explained below, the controller includes control circuitry and programming for controlling the engine speed. Continuous shifting of the compressor operating speed inhibits the creation of standing waves in the piping, which avoids amplification of piping system resonances.

Controller 17 is equipped with processing and memory devices, appropriate input and output devices, and an appropriate user interface. It is programmed to perform the various control tasks and deliver control parameters to the compressor system. Given appropriate input data, output specifications, and control objectives described herein, algorithms for programming controller 17 may be developed and executed.

Compressor 12 is operated at a speed that is dictated by the pressure and flow requirements of the gas transmission pipeline. As long as suction and discharge pressure and flow conditions remain the same, the compressor speed need not change.

As explained below, the "compressor speed" for purposes of the present invention is an "average compressor speed" as a result of frequency modulation about a given operating speed. In contrast, in a conventional compressor system, the compressor speed is "fixed". Most modern compressors are capable of operating over a range of speeds so that they can adjust to the demands of the pipeline. However, in conventional compressor operation, the fixed compressor speed changes only two or three times per day (at most) because pipeline operating demands tend to be quite stable.

A feature of the invention is the focus on the excitation source for pulsation avoidance. To create pipeline pulsations, two components are necessary: a pulsation excitation source and an acoustic pipe response of a matching wavelength. If the frequency of the compressor's piston-valve pressure pulsations coincides with an acoustic length of an upstream or downstream pipe, an acoustic resonance condition exists.

As stated in the Background, the result of the resonance condition is pressure pulsations that can damage the compressor system or its piping. Filter bottles 18*a* and 18*b* are an example of conventional technology that seeks to induce a pressure loss and thereby affect the wave shape. Examples of other conventional pulsation control techniques include special orifice and choke tube designs.

Figure 2:
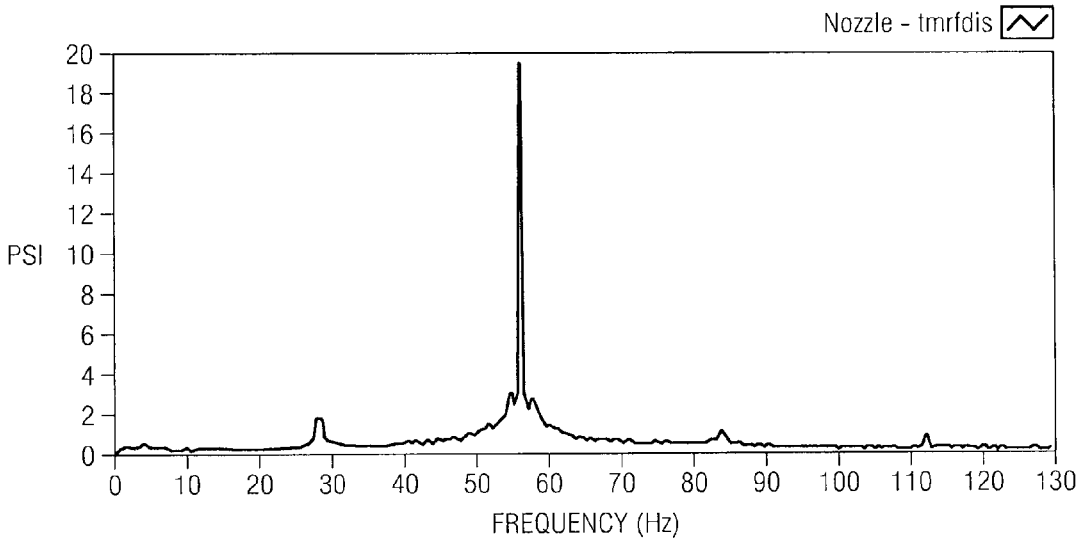
FIG. 2 illustrates the piping response to pulsation of an example compressor system.

FIG. 2 illustrates the resonant response of an example compressor piping system. The compressor system is assumed to have the following characteristics:

250 Hp Driver

Pressure ratio 2.0

Operating speed=500-900 RPM

Typical natural gas working fluid

A pulsation prediction tool for the above compressor case was used to obtain the response of FIG. 2, which shows all resonance frequencies. A clear 56 Hz piping resonance response exists in the system.

Figure 3:
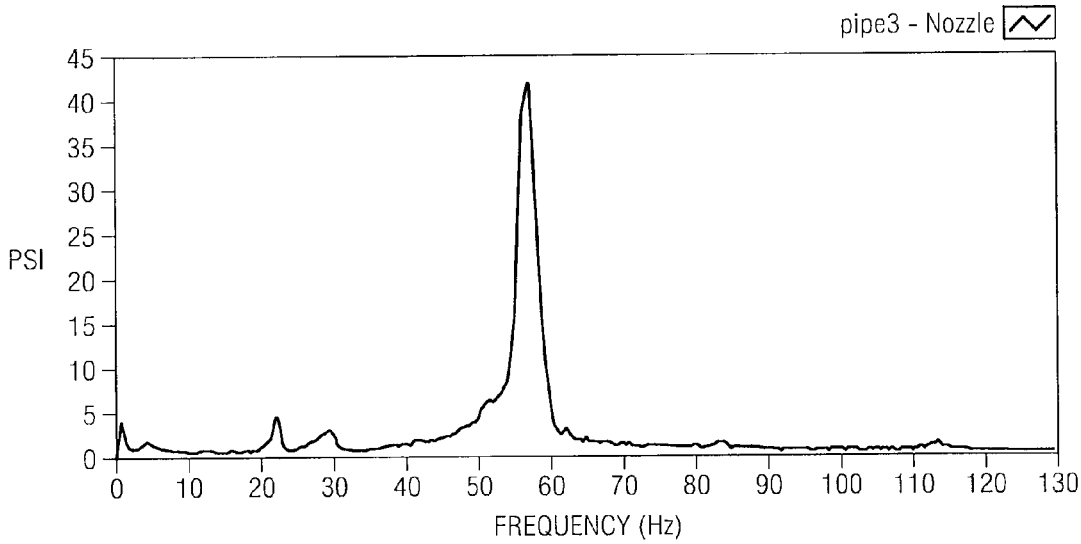
FIG. 3 illustrates the piping response of the example compressor system, with the compressor operating at the worst case fixed engine speed.

FIG. 3 illustrates worst case operating conditions for the compressor system of FIG. 1. The compressor is run at the worst case fixed speed (840 rpm), where the excitation coincides perfectly with system's worst resonance frequency for the 4th excitation order of the compressor (4th order=(840/60)*4). Clearly, a very high pressure peak-to-peak pulsation of 42 psi peak to peak is generated because of the resonance excitation.

Figure 4:
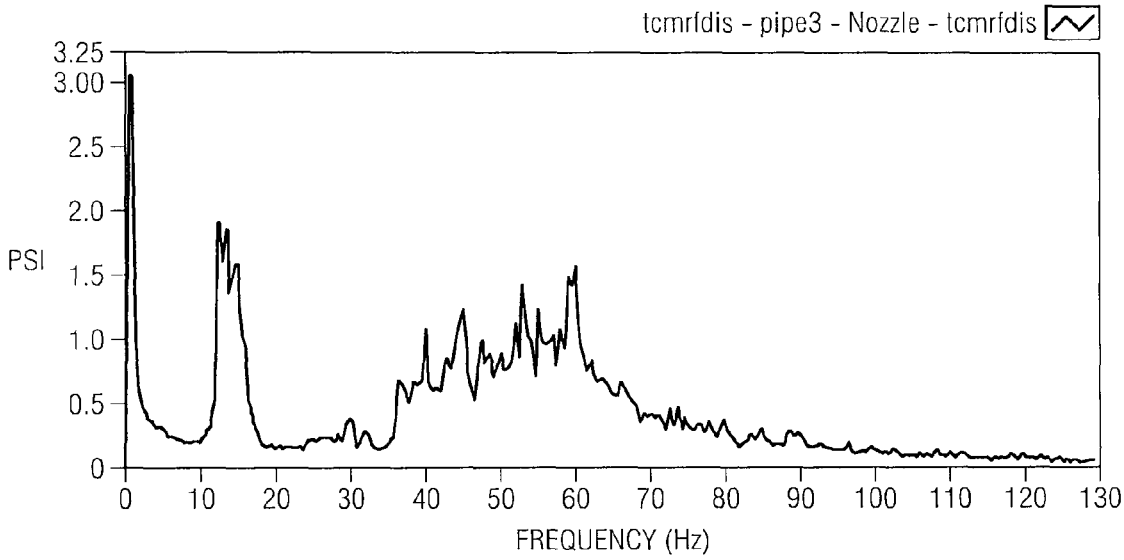
FIG. 4 illustrates the piping response of the example compressor system, with the compressor operating at the same average engine speed as in FIG. 3, but with frequency modulation of the engine speed.

FIG. 4 illustrates the response of the same compressor run at the same average speed of 840 rpm, to meet the same pressure ratio and flow rate requirements, but with frequency modulation applied in accordance with the invention. The peak-to-peak pulsations at 56 Hz are reduced to 1.5 psi.

FIG. 4 demonstrates the potential for pulsation reduction using continuous modulation of the compressor speed. The amount of reduction will depend on the bandwidth of the piping system response, the probabilistic distribution chosen for the random modulation, the range of the frequency distribution, and the implementation of the modulation (how quickly speed is allowed to change and how quickly the compressor and driver respond to the prescribed speed change).

More specifically, control unit 17 is programmed to control the engine speed to modulate the excitation frequency about a given operating (average) engine speed. In other words, the method relies on modulation of the excitation frequency of the compressor such that, although the compressor never operates at a single frequency, the compressor's average operating speed results in the required average compression and flow performance. This is accomplished by continuously and randomly varying the running speed of the compressor about the desired operating point within a prescribed range.

The speed ramp rate and range (both increasing and decreasing) of the compressor may be probabilistically determined. The overall statistical distribution is such that it minimizes the formation of coherent waves in the piping system while still maintaining the compressor's desired performance over a reasonable time period.

Control unit 17 may be programmed with any one of various algorithms and statistical distributions. The programming controls the compressor speed by controlling both the ramp rate and range. The optimal selection of the specific control method depends on the specific resonances that are to be avoided and the mechanical limitations of the compressor and driver (engine or motor). The control method can be implemented through a variety of electrical, mechanical or hydraulic means, such as a controlled variable frequency drive (for electric motor drives) or variable speed gears (for gas engine drivers).

Control unit 17 may be programmed to automatically perform at least the process of determining the driver speed modulation characteristics and the delivery of control signals to the driver. Data representing the desired operating speed for given system flow and pressure, as well as the frequency response(s) to be avoided, may be input from other sources, or may also be determined by appropriate programming of the control unit or associated processing devices.

Figure 5:
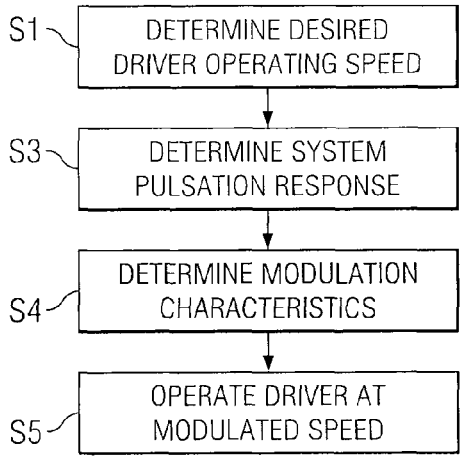
FIG. 5 illustrates a method of controlling the driver for a gas compressor in accordance with the invention.

FIG. 5 illustrates a method of controlling the speed of a driver for a reciprocating gas compressor system. As explained above, the driver may be an engine or motor.

Step 51 is determining a desired operating speed for the driver. This determination is typically primarily based on desired pipeline flow and pressure parameters.

Step 52 is determining the pulsation response of the system at that operating speed. This may be accomplished by direct feedback from sensors associated with the system, such as by one or more dynamic pressure sensors in the piping and/or vibration sensors on the piping. Alternatively, the pulsation response may be estimated from historic data from past system responses. As a third alternative, the pulsation response data may be obtained from a compressor system modeling and pulsation prediction tool, such as that used to obtain the data of FIGS. 2-4.

Step 53 is determining the modulation characteristics for modulating the operating speed in a manner that will result in an equivalent average operating speed and that will minimize any resonant response(s) of the system. As explained above, this determination uses probabilistic techniques to determine a random modulation. Various algorithms may be used to receive input data, such as data representing the desired average operating speed and the resonant response, and to determine continuously varying speeds and rates of change that will minimize the pulsation response of the compressor system.

Step 55 is using the modulation data to vary the speed of the compressor driver. As explained above, this results in reduced system pulsations.

Step 55 is performed by control unit 17, and the extent to which the other above steps are performed by control unit 17 is a design choice. For example, the desired operating speed and the pulsation response may be determined from other sources or by additional programming of the control unit 17. Similarly, the modulation characteristics could be algorithmically determined in real time by control unit 17 or could be accessed from stored data. For purposes of this description, a "determination" of data by control unit 17 is to be interpreted broadly and could include for example, receiving data from sensors or another processing unit, accessing the data from memory, or by on-board calculation.

What is claimed is:

1. A method of reducing pulsations associated with a reciprocating gas compressor system, the compressor system having an engine or motor as a driver for the compressor pistons; comprising:

determining a desired operating speed of the compressor driver;

determining the frequency response of the compressor system at the desired operating speed;

using the frequency response data to determine modulation characteristics for the desired operating speed, such that the actual operating speed will vary about the desired operating speed; and operating the driver at an average speed having the modulation characteristics determined in the preceding step.

2. The method of claim 1, wherein the driver is a motor and the modulation characteristics vary the speed of the motor.

3. The method of claim 1, wherein the driver is an engine and the modulation characteristics vary the speed of the engine.

4. The method of claim 1, wherein the modulation characteristics include at least a range of engine speeds.

5. The method of claim 1, wherein the modulation characteristics include at least a rate of change of the engine speed.

6. The method of claim 1, wherein the step of using the frequency response data to determine modulation characteristics is performed using a probabilistic distribution technique.

7. The method of claim 1, wherein at least the steps of using the frequency response data to determine modulation characteristics and of operating the driver are performed automatically by a control unit.

8. A control unit for controlling a reciprocating gas compressor system driver to reduce pulsations associated with the compressor system, the compressor system having an engine or motor as a driver for the compressor pistons; comprising:

a control unit programmed to perform the following process:

determine a desired operating speed of the compressor driver;

determine frequency response data representing the pulsation response of the compressor system at the desired operating speed;

use the frequency response data to determine modulation characteristics for the desired operating speed, such that the actual operating speed will vary about the desired operating speed; and to deliver control signals to the driver to operate the driver at an average speed having the modulation characteristics.

9. The control unit of claim 8, wherein the driver is a motor and the modulation characteristics vary the speed of the motor.

10. The control unit of claim 8, wherein the driver is an engine and the modulation characteristics vary the speed of the engine.

11. The control unit of claim 8, wherein the modulation characteristics include at least the range of engine speeds.

12. The control unit of claim 8, wherein the modulation characteristics include at least the rate of change of the engine speed.

13. The control unit of claim 8, wherein the step of using the frequency response data to determine modulation characteristics is performed using a probabilistic distribution technique.

14. The control unit of claim 8, wherein the step of determining frequency response data is performed by receiving data from sensors associated with the compressor system.

15. A control unit for controlling a reciprocating gas compressor system driver to reduce pulsations associated with the compressor system, the compressor system having an engine or motor as a driver for the compressor pistons; comprising:

a control unit programmed to perform the following process:

determine a desired operating speed of the compressor driver;

estimate frequency response data representing the pulsation response of the compressor system at the desired operating speed;

use the frequency response data to determine modulation characteristics for the desired operating speed, such that the actual operating speed will vary about the desired operating speed; and to deliver control signals to the driver to operate the driver at an average speed having the modulation characteristics.

16. The control unit of claim 15, wherein the driver is a motor and the modulation characteristics vary the speed of the motor.

17. The control unit of claim 15, wherein the driver is an engine and the modulation characteristics vary the speed of the engine.

18. The control unit of claim 15, wherein the modulation characteristics include at least the range of engine speeds.

19. The control unit of claim 15, wherein the modulation characteristics include at least the rate of change of the engine speed.

20. The control unit of claim 15, wherein the step of using the frequency response data to determine modulation characteristics is performed using a probabilistic distribution technique.

* * * * *